US008349164B2

(12) United States Patent
Furuta et al.

(10) Patent No.: US 8,349,164 B2
(45) Date of Patent: Jan. 8, 2013

(54) CONDUCTIVE DIAMOND ELECTRODE STRUCTURE AND METHOD FOR ELECTROLYTIC SYNTHESIS OF FLUORINE-CONTAINING MATERIAL

(75) Inventors: Tsuneto Furuta, Fujisawa (JP); Setsuro Ogata, Fujisawa (JP); Masaharu Uno, Fujisawa (JP)

(73) Assignee: Permelec Electrode Ltd., Kanagawa (JP)

( * ) Notice: Subject to any disclaimer, the term of this patent is extended or adjusted under 35 U.S.C. 154(b) by 953 days.

(21) Appl. No.: 12/142,878

(22) Filed: Jun. 20, 2008

(65) Prior Publication Data

US 2008/0314759 A1 Dec. 25, 2008

(30) Foreign Application Priority Data

Jun. 22, 2007 (JP) ..... 2007-165167

(51) Int. Cl.
*C25B 1/24* (2006.01)
*C25B 11/06* (2006.01)
*C25B 11/12* (2006.01)

(52) U.S. Cl. ..... 205/359; 204/290.15; 204/294; 205/411; 205/556

(58) Field of Classification Search ..... 204/290.15, 204/294; 205/356, 359, 411, 556; 292/251
See application file for complete search history.

(56) References Cited

U.S. PATENT DOCUMENTS

| | | | | |
|---|---|---|---|---|
| 5,489,368 | A * | 2/1996 | Suitsu et al. | 204/280 |
| 5,626,730 | A | 5/1997 | Shumamune et al. | |
| 6,440,293 | B2 * | 8/2002 | Morokuma et al. | 205/359 |
| 7,285,194 | B2 * | 10/2007 | Uno et al. | 204/290.15 |
| 7,335,285 | B2 * | 2/2008 | Furuta et al. | 204/290.15 |
| 2004/0146779 | A1 | 7/2004 | Haenni et al. | |
| 2006/0219570 | A1 | 10/2006 | Furuta et al. | |
| 2007/0095655 | A1 | 5/2007 | Stadelmann et al. | |

FOREIGN PATENT DOCUMENTS

| | | | |
|---|---|---|---|
| DE | 100 15 209 | A1 | 10/2001 |
| DE | 100 25 167 | A1 | 12/2001 |
| JP | 60-221591 | A | 11/1985 |
| JP | 7-316861 | A | 12/1995 |
| JP | 2000-313981 | A | 11/2000 |
| JP | 2006-249552 | A | 9/2006 |
| JP | 2006-249557 | A | 9/2006 |
| KR | 10-2006-0100219 | A | 9/2006 |

* cited by examiner

*Primary Examiner* — Keith Hendricks
*Assistant Examiner* — Steven A. Friday
(74) *Attorney, Agent, or Firm* — Sughrue Mion, PLLC

(57) ABSTRACT

The present invention provides a conductive diamond electrode structure for use in electrolytic synthesis of a fluorine-containing material with a fluoride ion-containing molten salt electrolytic bath, which comprises: a conductive electrode feeder; and a conductive diamond catalyst carrier comprising a conductive substrate and a conductive diamond film carried on a surface thereof, wherein the conductive diamond catalyst carrier is detachably attached to the conductive electrode feeder at a portion to be immersed in the electrolytic bath. Also disclosed is an electrolytic synthesis of a fluorine-containing material using the conductive diamond electrode structure.

6 Claims, 3 Drawing Sheets

PRIOR ART

CONDUCTIVE DIAMOND ELECTRODE STRUCTURE AND METHOD FOR ELECTROLYTIC SYNTHESIS OF FLUORINE-CONTAINING MATERIAL

TECHNICAL FIELD

The present invention relates to a conductive diamond electrode structure used for electrolytic synthesis of a fluorine-containing material using a fluoride ion-containing molten salt electrolytic bath and a method for electrolytic synthesis of a fluorine-containing material using the conductive diamond electrode structure.

BACKGROUND OF THE INVENTION

Fluorine gas or $NF_3$ gas is obtained by using a fluoride-containing molten salt such as KF.2HF or $NH_4$.2HF as an electrolyte and electrolyzing it.

As an electrolytic cell for electrolytic synthesis of the fluorine-containing material using the fluoride-containing molten salt as the electrolyte, there is used a box-shaped electrolytic cell partitioned into an anode chamber and a cathode chamber with a partition wall. Lower portions of electrodes are immersed in the molten salt, and these electrodes are connected to feeder bus bars in the electrolytic cell, thereby performing electrolysis. An electrode reaction proceeds at electrode portions immersed in the molten salt.

The HF vapor pressure of the fluoride-containing molten salt used as the electrolyte is high, so that an upper portion of the electrolytic cell which is not filled with the molten salt is filled with HF and fluorine gas or $NF_3$ gas as a product for the anode side, and HF and hydrogen gas for the cathode side.

Corrosiveness of the fluoride-containing molten salt itself is very high, and the fluorine gas and the $NF_3$ gas are also very high in corrosiveness and reactivity. Accordingly, for the electrode, particularly the anode, not only high catalytic activity to the desired electrode reaction is required at the portion immersed in the molten salt, at which the electrode reaction proceeds, but also reaction activity with the fluoride-containing molten salt and the fluorine gas or $NF_3$ gas generated must be low. On the other hand, at an upper portion not immersed in the molten salt, anti-corrosiveness to HF and the fluorine gas or $NF_3$ gas must be high, and reactivity to these must be low.

In industrial electrolysis, a carbon electrode or a nickel electrode has hitherto been used as an anode in many cases, and iron or nickel has been used as a cathode. The carbon electrode which has been practically used as an anode does not have sufficiently high anti-corrosiveness and low reactivity to the molten salt and the filled gas, and the nickel electrode also does not have sufficiently high anti-corrosiveness and low reactivity to the molten salt.

At the portion immersed in the molten salt, at which the electrode reaction proceeds, the carbon electrode reacts with the fluorine gas generated or a fluorine radical generated in a fluorine gas generation process to form graphite fluoride, thereby coming into a non-conductible state called an anode effect. Further, at a non-immersed portion, HF or the fluorine gas enters the inside of the electrode to cause electrode breakage to occur at a joint with the feeder bus bar and the like.

Accordingly, in conventional methods, in order to prevent entrance of HF or the fluorine gas and to inhibit the electrode breakage, it has been performed that the joint with the feeder bus bar is coated with nickel by a plating method or a thermal spraying method (for example, see patent document 1 and patent document 2).

Further, in the nickel electrode, the electrode breakage observed in the carbon electrode does not occur, but severe consumption occurs at the portion immersed in the molten salt.

Furthermore, as an electrolytic synthesis method of this kind, there has been proposed a conductive diamond electrode in which the anode effect observed in the carbon electrode and the electrode consumption observed in the nickel electrode do not occur and in which a conductive carbonaceous material showing high catalytic activity to the desired electrode reaction is used as a substrate (patent document 3).

In general, in industrial electrolytic synthesis of the fluorine gas or $NF_3$ gas using a fluoride-containing molten salt, a carbon electrode or a nickel electrode of about 300×1,000 mm has been used. Also when the conductive diamond electrode is used, a size of about 300×1,000 mm is necessary. The conductive diamond electrode is produced by forming a conductive diamond film on an electrode substrate by a gas-phase synthesis method such as a chemical vapor deposition (CVD) method or a physical vapor deposition (PVD) method. In an apparatus used widely, the size of the substrate applicable is approximately 300×300 mm or less, and it is difficult to produce an electrode having a size used in industrial electrolytic synthesis.

Only in a hot filament CVD method, one of the CVD method, an apparatus applicable to this size is present. However, even in this apparatus, it is difficult to form a uniform conductive diamond film to 300×1,000 mm, resulting in an expensive price. Further, also as for a hot filament CVD apparatus, a general-purpose type targets at approximately 300×300 mm or less.

When the fluorine gas or $NF_3$ gas is synthesized using the conductive diamond electrode, a place requiring the conductive diamond film is only the portion to be immersed in the molten salt, at which the electrode reaction proceeds. However, in the above-mentioned CVD method or PVD method, it is necessary to insert the whole substrate into a reaction vessel, which inhibits an improvement in productivity and causes an increase in production cost.

The conductive diamond electrode is an excellent material exhibiting high catalytic activity and anti-corrosiveness. However, HF or the fluorine gas can not be prevented from entering the non-immersed portion, so that the problem of electrode breakage has not been solved yet.

In order to solve the problem of electrode breakage, it is necessary to coat a joint with a feeder bus bar with nickel, similarly to the carbon electrode. In order to coat the joint with nickel, the conductive diamond film once formed is required to be separated, which necessitates a complicated operation. A method of coating the joint with nickel before the conductive diamond layer is formed is impractical, because coated nickel deteriorates in a process of forming the conductive diamond layer.

Even when the conductive diamond electrode in which the joint with the feeder bus bar is coated with nickel is used, a process leading to electrode breakage (deterioration mode) is different from deterioration mode of an electrode catalyst immersed in the molten salt. Accordingly, the times taken for both to lead to deterioration are different from each other. Even when either of them is deteriorated, the electrode is required to be changed. It is difficult and useless to design so as to equalize the times taken for both to lead to deterioration, and it is desired that a portion not deteriorated can be reused.

Patent Document 1: JP-A-2000-313981

Patent Document 2: JP-A-60-221591

Patent Document 3: JP-A-2006-249557

SUMMARY OF THE INVENTION

In the case where fluorine gas or $NF_3$ gas is synthesized using a conductive diamond electrode in accordance with the foregoing background techniques, a place requiring the conductive diamond film is only the portion to be immersed in the molten salt, at which the electrode reaction proceeds. However, in the CVD method or PVD method, it is necessary to insert the whole substrate into a reaction vessel, which inhibits an improvement in productivity and causes an increase in production cost.

Moreover, the process leading to electrode breakage (deterioration mode) is different from deterioration mode of the electrode catalyst immersed in the molten salt, so that the times taken for both to lead to deterioration are different from each other. Even when either of them is deteriorated, the electrode is required to be changed. It is difficult and useless to design so as to equalize the times taken for both to lead to deterioration, and it is desired that the portion not deteriorated can be reused.

An object of the invention is to solve the above-mentioned conventional disadvantages, and to provide a conductive diamond electrode structure which simply and easily constitutes a conductive diamond electrode having a catalyst portion and a feeder portion different from each other in required characteristics and in which either of the catalyst portion deteriorated and the feeder portion deteriorated is easily exchangeable and a method for electrolytic synthesis of a fluorine-containing material using the same.

Other objects and effects of the present invention will become apparent from the following description.

Then, in order to achieve the above-mentioned objects, the present invention provides the following conductive diamond electrode structures and electrolytic synthesis method.

(1) A conductive diamond electrode structure for use in electrolytic synthesis of a fluorine-containing material with a fluoride ion-containing molten salt electrolytic bath, which comprises:

a conductive electrode feeder; and a conductive diamond catalyst carrier comprising a conductive substrate and a conductive diamond film carried on a surface thereof, wherein the conductive diamond catalyst carrier is detachably attached to the conductive electrode feeder at a portion to be immersed in the electrolytic bath.

(2) The conductive diamond electrode structure according to item (1) above, wherein the conductive diamond film is formed by a gas-phase synthesis method.

(3) The conductive diamond electrode structure according to item (2) above, wherein the gas-phase synthesis method is a chemical vapor deposition method.

(4) The conductive diamond electrode structure according to item (1) above, wherein the conductive electrode feeder comprises any one of a conductive carbonaceous material, nickel and a MONEL alloy.

(5) The conductive diamond electrode structure according to item (1) above, wherein the conductive substrate comprises any one of a conductive carbonaceous material, nickel and a MONEL alloy.

(6) The conductive diamond electrode structure according to item (1) above, wherein the conductive diamond catalyst carrier is detachably attached to the conductive electrode feeder with a screw or with a bolt and a nut.

(7) The conductive diamond electrode structure according to item (6) above, wherein the screw or the bolt and nut comprises any one of a conductive carbonaceous material, nickel and a MONEL alloy.

(8) The conductive diamond electrode structure according to item (1) above, wherein the conductive electrode feeder is a conductive carbonaceous material, and a metal coating film is formed on a bus bar joint at an upper end of the conductive electrode feeder by plating or thermal spraying.

(9) The conductive diamond electrode structure according to item (8) above, wherein the metal that forms the metal coating film is a metal selected from the group consisting of a conductive carbonaceous material, nickel and a MONEL alloy.

(10) A method for electrolytic synthesis of a fluorine-containing material comprising:

holding the conductive diamond electrode structure according to item (1) above so that the conductive diamond catalyst carrier is immersed in a fluoride ion-containing molten salt electrolytic bath, and performing electrolysis, thereby electrolytically synthesizing a fluorine-containing material.

The invention has the advantages enumerated below:

1) It becomes possible to carry conductive diamond on only the catalyst portion at which the electrode reaction proceeds, which contributes to improvement in productivity and a decrease in production cost;

2) When either the catalyst portion or the feeder portion is deteriorated, only the deteriorated portion becomes easily exchangeable, and the portion not deteriorated can be reused;

3) The material and structure suitable for each of the catalyst portion and the feeder portion become selectable, which contributes to improvement in productivity and a decrease in production cost; and 4) It becomes possible to arrange the conductive diamond carrier, limiting to the catalyst portion and dividedly, so that a general-purpose machine can be utilized in industrial-scale electrode production.

Figure 1:
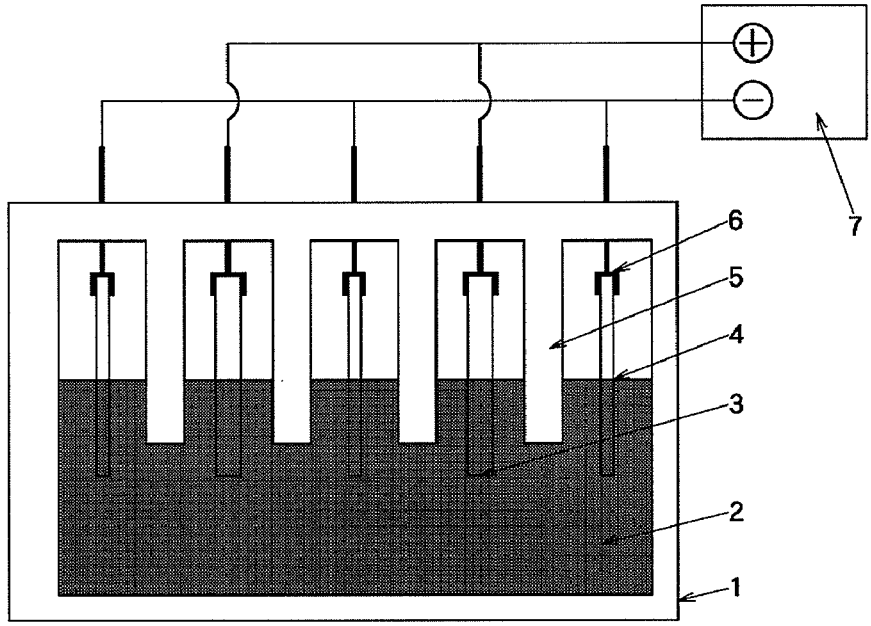
FIG. 1 is a schematic view showing an electrolytic cell for electrolytic synthesis of a fluorine-containing material using a conductive diamond electrode structure according to the invention.

The reference numerals used in the drawings denote the following, respectively.

1: Electrolytic Cell
2: Electrolytic Bath
3: Anode
4: Cathode
5: Partition Wall
6: Feeder Bus Bar
7: Rectifier
8: Conductive Feeder
9: Conductive Diamond Catalyst Carrier

10: Bolt and Nut or Screw
11: Mounting Hole
12: Conductive Substrate
13: Conductive Diamond Film
14: Metal Coating Layer

DETAILED DESCRIPTION OF THE INVENTION

The invention will be described in detail below.

Figure 2:
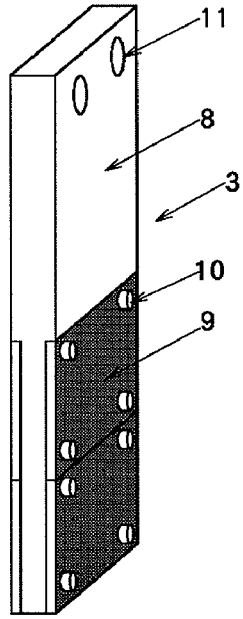
FIG. 2 is a schematic view showing a first embodiment of a conductive diamond electrode structure according to the invention.

FIG. 1 is a schematic view showing an electrolytic cell for electrolytic synthesis of a fluorine-containing material using the conductive diamond electrode structure according to the invention. Reference numeral 1 designates an electrolytic cell for electrolytic synthesis of a fluorine-containing material using a fluoride ion-containing molten salt electrolytic bath 2 comprising a mixed molten salt (KF.2HF or $NH_4$.2HF) and the like, reference numerals 3, 4 and 5 designate an anode, a cathode and a partition wall, respectively, which are to be immersed in the molten salt electrolytic bath 2, reference numeral 6 designates a feeder bus bar, and reference numeral 7 designates a rectifier. FIG. 2 is a schematic view showing one embodiment of the conductive diamond electrode structure according to the invention, which is used as the anode 3. The anode 3 comprises a conductive electrode feeder 8 and a conductive diamond catalyst carrier 9 comprising a conductive substrate and a conductive diamond film carried on a surface thereof, and the conductive diamond catalyst carrier 9 is detachably attached to the conductive electrode feeder 8 at a portion to be immersed in the electrolytic bath 2 with a bolt and nut or a screw 10. The electrode feeder 8 and the bolt and nut or the screw is constituted by a conductive carbonaceous material, nickel, a MONEL alloy or the like. The anode 3 is connected to the feeder bus bar 6 by means of mounting holes 11. As the cathode 4, there is used nickel, stainless steel or the like. The cathode 4 is also similarly connected to the feeder bus bar 6.

Figure 3:
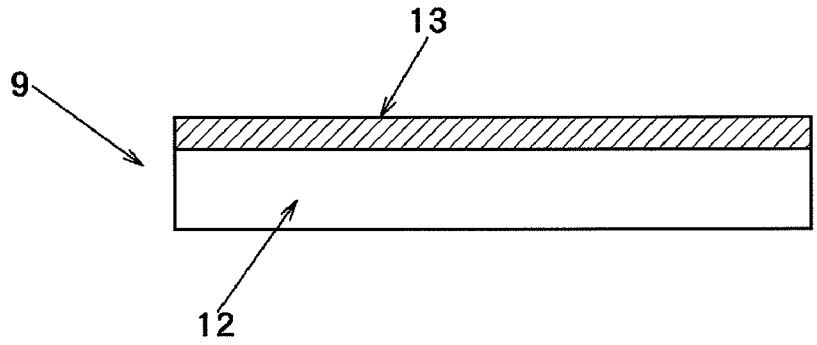
FIG. 3 is a view showing a cross-sectional structure of a conductive diamond catalyst carrier 9 of a conductive diamond electrode structure according to the invention.

FIG. 3 shows a cross-sectional structure of the conductive diamond catalyst carrier 9, and the conductive diamond catalyst carrier 9 comprises the conductive substrate 12 and the conductive diamond film 13 carried on a surface thereof. The conductive substrate 12 is constituted by a conductive carbonaceous material, nickel, a MONEL alloy or the like.

Figure 4:
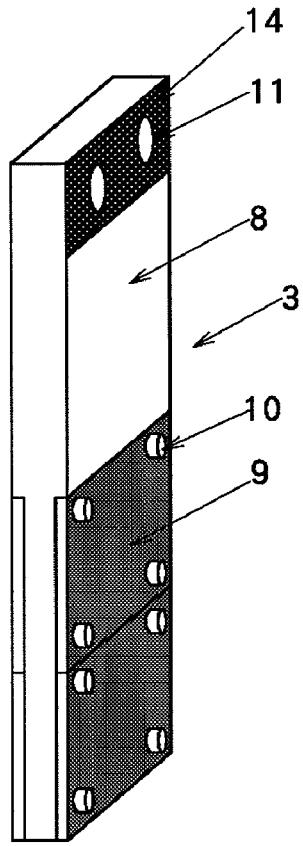
FIG. 4 is a schematic view showing a second embodiment of a conductive diamond electrode structure according to the invention.
Figure 5:
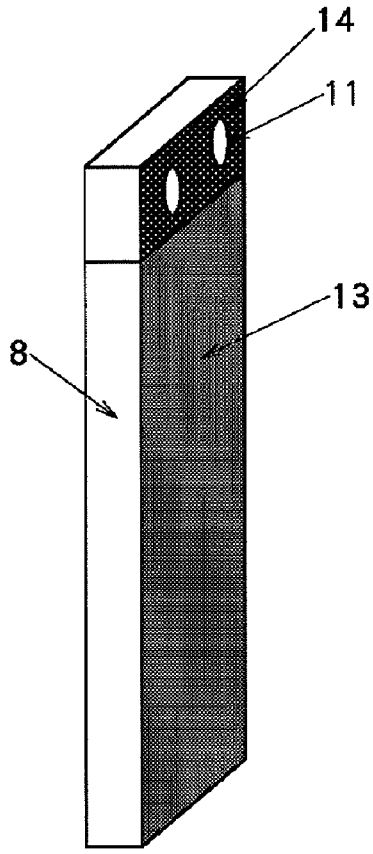
FIG. 5 is a schematic view showing a conventional conductive diamond electrode structure.

FIG. 4 is a schematic view showing a second embodiment of the conductive diamond electrode structure according to the invention, in which a bus bar joint at an upper portion of the conductive electrode feeder 8 is provided with a metal coating layer 14 such as nickel by a thermal spraying method. In order to solve the problem of electrode breakage, a conventional electrode is also provided with a nickel coating layer 14 similarly to a carbon electrode, as shown in FIG. 5. However, it is necessary to directly coat the conductive electrode feeder 8 with nickel after the conductive diamond film 13 formed has been once separated, which necessitates a complicated operation. According to the invention, however, the upper portion of the conductive electrode feeder 8 has no conductive diamond film 13, so that the metal coating layer 14 such as nickel can be formed on the bus bar joint at the upper portion of the conductive electrode feeder 8 without necessity of its separation. As the metal coating layer 14, tin, lead, zinc, copper, silver, gold, aluminum, steel, a MONEL alloy or the like, as well as nickel can be used. However, nickel or a MONEL alloy is preferred.

A method for allowing the conductive diamond film 13 to be carried on the conductive substrate 12 is not particularly limited, and any one can be used. As a typical production method, a gas-phase synthesis method can be used, and as the gas-phase synthesis method, there can be used a chemical vapor deposition (CVD) method, a physical vapor deposition (PVD) method or a plasma arc jet method. Further, as the chemical vapor deposition (CVD) method, a hot filament CVD method, a microwave plasma CVD method or the like can be used.

When the conductive diamond film 13 is allowed to be carried on, a mixed gas of hydrogen gas and a carbon source is used as a raw material for diamond in any one of the methods. In order to impart conductivity to diamond, an element different in atomic value (hereinafter referred to as a dopant) is added in slight amounts. As the dopant, phosphorus or nitrogen is preferred. The content thereof is preferably from 1 to 100,000 ppm, and more preferably from 100 to 10,000 ppm. Even when any one of the diamond production methods is used, the conductive diamond layer synthesized is polycrystalline, and amorphous carbon or a graphite component remains in the diamond layer. From the viewpoint of stability of the diamond layer, the less amorphous carbon or graphite component is preferred. It is preferred that the ratio I(D)/I(G) of peak intensity I(D) existing in the vicinity of 1332 $cm^{-1}$ (in the range of 1312 to 1352 $cm^{-1}$) attributing to diamond to peak intensity I(G) in the vicinity of 1580 $cm^{-1}$ (in the range of 1560 to 1600 $cm^{-1}$) attributing to the G band of graphite in Raman spectroscopic analysis is 1 or more, and that the content of diamond is larger than that of graphite.

The hot filament CVD method which is one of the most preferred methods for allowing the conductive diamond film 13 to be carried on the conductive substrate 12 will be illustrated. An organic compound such as methane, an alcohol or acetone acting as the carbon source and the dopant are supplied to a filament together with hydrogen gas. The filament is heated to a temperature of 1,800 to 2,800° C. at which hydrogen radicals and the like are generated, and the conductive substrate is arranged in this atmosphere so as to become a temperature region (750 to 950° C.) in which diamond is precipitated. Although the supply rate of the mixed gas depends on the size of a reaction vessel, the pressure is preferably from 15 to 760 Torr.

Polishing of a surface of the conductive substrate 12 is preferred, because adhesion between the conductive substrate 12 and a diamond layer of the diamond film is improved. The arithmetic average roughness Ra is preferably from 0.1 to 15 μm, and the maximum height Rz is preferably from 1 to 100 μm. Seeding of a diamond powder on the surface of the substrate 12 is effective for uniform growth of the diamond layer. A fine diamond particle layer having a particle size of 0.001 to 2 μm is usually precipitated on the substrate 12. Although the thickness of the diamond layer can be controlled by the vapor deposition time, it is preferably from 1 to 10 μm from the viewpoint of economic efficiency.

Using the conductive diamond electrode as the anode 3 and nickel, stainless steel or the like as the cathode 4, electrolysis is performed in a KF-2HF, $NH_4F$-(1-3)HF or $NH_4F$—KF—HF molten salt at a current density of 1 to 100 $A/dm^2$, thereby being able to obtain $F_2$ or $NF_3$ from the anode. Further, another fluorine compound can also be obtained by changing the bath composition.

As a material for the electrolytic cell 1, mild steel, a nickel alloy, a fluororesin or the like can be used in terms of corrosion resistance to high-temperature hydrogen fluoride. In order to prevent $F_2$ or a fluorine compound synthesized on the anode from being mixed with hydrogen gas generated on the cathode, it is preferred that the anode side and the cathode side are partitioned from each other by a partition wall, a diaphragm or the like.

The KF-2HF molten salt as the above-mentioned electrolytic bath is prepared by blowing anhydrous hydrogen fluoride gas into potassium acid fluoride, the $NH_4F$-(1-3)HF molten salt by blowing anhydrous hydrogen fluoride gas into ammonium monohydrogen difluoride and/or ammonium fluoride, and the $NH_4F$—KF—HF molten salt by blowing anhydrous hydrogen fluoride gas into potassium acid fluoride and ammonium monohydrogen difluoride and/or ammonium fluoride.

The electrolytic bath immediately after preparation is contaminated with about several hundred ppm of water, so that the electrolytic bath using the conventional carbon electrode as the anode has required removal of water by dehydration electrolysis at a low current density of 0.1 to 1 A/dm$^2$ or the like, in order to inhibit the anode effect. However, according to the electrolytic bath using the conductive diamond electrode of the invention, it is possible to perform dehydration electrolysis at a high current density, which makes it possible to complete dehydration electrolysis for a short period of time. Further, it is also possible to begin operation at a specified current density without performing dehydration electrolysis.

A slight amount of HF accompanying $F_2$ or the fluorine compound generated on the anode can be removed by passing it through a column filled with granular sodium fluoride. Further, nitrogen, oxygen and dinitrogen monoxide are produced in slight amounts as by-products in the synthesis of $NF_3$. Of these, dinitrogen monoxide can be removed by passing it through water and sodium thiosulfate, and oxygen can be removed by active carbon. It becomes possible to synthesize high-purity $F_2$ or $NF_3$ by removing the trace gases accompanying $F_2$ or $NF_3$ by such methods.

The electrode consumption and the occurrence of sludge scarcely proceed during electrolysis, so that the frequency of electrolysis stoppage due to electrode renewal and electrolytic bath renewal decreases. It is possible to stably synthesize $F_2$ or $NF_3$ over a long period of time by only supplying HF consumed by electrolysis or HF and $NH_4F$.

EXAMPLES

The present invention will be illustrated in greater detail with reference to the following Examples and comparative Examples, but the invention should not be construed as being limited thereto.

Example 1

1) The electrode structure shown in FIG. 2 was prepared by the following procedures:

2) Holes for screw fixing were opened in four corners of a conductive substrate 12 made of a carbon material with a size of W 200×L 100×T 5 mm. One side of the conductive substrate 12 was polished with a polishing agent comprising diamond particles having a particle size of 1 μm, and then, seeded with diamond particles having a particle size of 4 nm. The resulting substrate was mounted on a hot filament CVD apparatus.

3) As the hot filament CVD apparatus, there was used a general-purpose apparatus on which a substrate with 300×300 mm or less was mountable.

4) The pressure in the apparatus was maintained at 75 Torr while allowing a mixed gas to flow in the apparatus at a rate of 10 liters/min, the mixed gas being obtained by adding 1% by volume of methane gas and 0.5 ppm of trimethylboron gas to hydrogen gas, and electric power is applied to a filament to elevate the temperature to 2400° C. The temperature of the substrate at this time was 860° C. The CVD operation was continued for 8 hours to prepare a conductive diamond carrier 9 in which a 3-μm conductive diamond film 13 was formed on the one side of the substrate 12.

5) A carbon substrate with a size of W 200×L 300×T 30 mm was subjected to cutting processing and tap processing of holes for screw fixing to prepare a conductive electrode feeder 8.

6) The conductive diamond carriers 9 prepared in 4) were attached to both sides of the feeder 8 for every 2 sheets with screws made of carbon to prepare the conductive diamond electrode structure.

7) Four substrates with a size of W 200×L 100×T 5 mm could be mounted on the CVD apparatus, so that only one CVD operation was required for the preparation of the electrode structure.

8) A feeder bus bar 6 was connected to an upper portion of the conductive electrode feeder 8, and constant-current electrolysis was performed at a current density of 100 A/dm$^2$, using 200 mm from a lower end as an anode 3 in a state where it was immersed in a KF.2HF-based molten salt maintained at 90° C. and a nickel plate as a cathode 4. The cell voltage after 24 hours was 8.0 V. Gas generated on the anode at this time was analyzed. As a result, the gas generated was $F_2$, and the generation efficiency thereof was 97%.

9) Further, the electrolysis was continued under the same conditions. As a result, the cell voltage was about 8.0 V up to 6,000 hours. However, thereafter, the cell voltage rapidly increased to result in impossibility of electrolysis.

10) The electrode structure was taken out from the electrolytic cell, and it was found that the feeder made of carbon was broken at a feeder-bus bar joint. On the other hand, no deterioration of the conductive diamond carrier 9 was observed.

Example 2

1) The carbon-made conductive electrode feeder 8 broken in Example 1 was replaced by a carbon-made conductive electrode feeder 8 in which a metal coating layer 14 made of nickel was formed on a bus bar joint by a thermal spraying method as shown in FIG. 4, and the conductive diamond carrier 9 was continuously used to prepare an electrode structure.

2) Constant-current electrolysis was performed by the same electrolytic method as in Example 1 under the same conditions as in Example 1. As a result, the cell voltage after 24 hours was 8.0 V, and the generation efficiency of $F_2$ gas was 97%.

3) Further, the electrolysis was continued under the same conditions. As a result, the cell voltage after 6,000 hours was 8.0 V, and the generation efficiency of $F_2$ gas at this time was 97%.

4) The electrolysis was interrupted and the electrode structure was taken out from the electrolytic cell. It was found that about 30% of the diamond film of the conductive diamond carrier was separated. On the other hand, no breakage of the carbon feeder coated with nickel was observed.

Example 3

1) The conductive diamond carrier 9 in which the diamond film was separated in Example 2 was replaced by an unused conductive diamond carrier prepared in the same manner as in Example 1, and the electrode feeder 8 in which the metal coating layer 14 made of nickel was formed was continuously used to prepare an electrode structure.

2) Constant-current electrolysis was performed by the same electrolytic method as in Example 1 under the same conditions as in Example 1. As a result, the cell voltage after 24 hours was 8.0 V, and the generation efficiency of $F_2$ gas at this time was 97%.

3) Further, the electrolysis was continued under the same conditions. As a result, the cell voltage after 6,000 hours was 8.0 V, and the generation efficiency of $F_2$ gas was 97%.

Example 4

1) An electrode structure was prepared in the same manner as in Example 1 with the exception that the electrode feeder was replaced by an electrode feeder made of nickel.

2) Constant-current electrolysis was performed by the same electrolytic method as in Example 1 under the same conditions as in Example 1. As a result, the cell voltage after 24 hours was 7.8 V, and the generation efficiency of $F_2$ gas at this time was 97%.

3) Further, the electrolysis was continued under the same conditions. As a result, the cell voltage after 6,000 hours was 7.8 V, and the generation efficiency of $F_2$ gas was 97%.

Example 5

1) An electrode structure was prepared in the same manner as in Example 1 with the exception that the electrode feeder was replaced by a carbon-made feeder 8 in which a metal coating layer 14 made of nickel was formed on a bus bar joint by a thermal spraying method.

2) A feeder bus bar was attached to an upper portion of the electrode feeder, and constant-current electrolysis was performed at a current density of 20 A/dm$^2$, using 200 mm from a lower end as an anode in a state where it was immersed in a $NH_4F.2HF$-based molten salt maintained at 90° C. and a nickel plate as a cathode. The cell voltage after 24 hours was 5.8 V. Gas generated on the anode at this time was analyzed. As a result, $NF_3$ gas was contained, and the generation efficiency of $NF_3$ gas was 60%.

3) Further, the electrolysis was continued under the same conditions. As a result, the cell voltage after 6,000 hours was 5.8 V, and the generation efficiency of $NF_3$ gas was 60%.

Example 6

1) A conductive diamond carrier was prepared in the same manner as in Example 1 with the exception of a carbon substrate with a size of W 300×L 300×T 5 mm.

2) One substrate with a size of W 300×L 300×T 5 mm could be mounted on the CVD apparatus, so that the CVD operation was performed four times to prepare four conductive diamond carriers.

3) A carbon-made feeder with a size of 300×1,000×50 mm was prepared by the same processing method as in example 1, and a feeder bus bar joint was coated with nickel by a thermal spraying method.

4) The conductive diamond carriers prepared in 2) were attached to both sides of the feeder for every 2 sheets with screws made of carbon to prepare a conductive diamond electrode structure.

5) The electrode structure was placed in a KF.2HF commercial electrolytic cell, and constant-current electrolysis was performed at a current density of 100 A/dm$^2$. The cell voltage after 24 hours was 8.0 V, and the generation efficiency of $F_2$ gas at this time was 97%.

6) Further, the electrolysis was continued under the same conditions. As a result, the cell voltage after 6,000 hours was 8.0 V, and the generation efficiency of $F_2$ gas was 97%.

Comparative Example 1

1) As shown in FIG. 5, polishing treatment and seeding treatment were performed on one side of a substrate composed of a graphite-made electrode with a size of W 200×L 300×T 30 mm, and a diamond film was prepared by the CVD operation under the same conditions as in Example 1. Further, a diamond film was also similarly formed on the opposite side to prepare a conductive diamond electrode.

2) One substrate with a size of W 200×L 300×T 30 mm could be mounted on the CVD apparatus, so that two CVD operations were required for the preparation of the electrode.

3) In order to form a metal coating layer 14 made of nickel on a feeder bus bar joint of the electrode, the conductive diamond film on the feeder bus bar joint was separated, and the metal coating layer 14 made of nickel was coated thereon by a thermal spraying method.

4) Constant-current electrolysis was performed by the same electrolytic method as in Example 1 under the same conditions as in Example 1. As a result, the cell voltage after 24 hours was 8.0 V, and the generation efficiency of $F_2$ gas at this time was 97%.

5) Further, the electrolysis was continued under the same conditions. As a result, the cell voltage was about 8.0 V up to 10,000 hours. However, thereafter, the cell voltage rapidly increased to result in impossibility of electrolysis.

6) The electrode structure was taken out from the electrolytic cell, and it was found that the electrode was broken at a feeder-bus bar joint. On the other hand, it was found that about 10% of the conductive diamond film immersed in a KF.2HF molten salt was separated.

7) After the feeder bus bar joint was cut and removed from the broken electrode, a feeder bus bar was connected thereto again, and constant-current electrolysis was performed at a current density of 100 A/dm$^2$ in a state where 10 mm from a lower end of the electrode was immersed in the KF.2HF-based molten salt maintained at 90° C. and a nickel plate as a cathode 4. The cell voltage after 24 hours was 8.0 V, and the generation efficiency of $F_2$ gas at this time was 97%.

While the present invention has been described in detail and with reference to specific embodiments thereof, it will be apparent to one skilled in the art that various changes and modifications can be made therein without departing from the spirit and scope thereof.

This application is based on Japanese Patent Application No. 2007-165167 filed Jun. 22, 2007, and the contents thereof are herein incorporated by reference.

Industrial Applicability

The invention is applicable to a conductive diamond electrode structure used for electrolytic synthesis of a fluorine-containing material using a fluoride ion-containing molten salt electrolytic bath and an electrolytic synthesis method for synthesizing a fluorine-containing material using a conductive diamond electrode structure.

What is claimed is:

1. A method for electrolytic synthesis of a fluorine-containing material using a conductive diamond electrode structure with a fluoride ion-containing molten salt electrolytic bath, which conductive diamond electrode structure comprises:

a conductive electrode feeder; and a conductive diamond catalyst carrier comprising a conductive substrate and a conductive diamond film carried on a surface thereof, wherein the conductive electrode feeder is exposed at an upper portion, not to be immersed in the electrolytic bath, to a gas zone containing a fluorine gas or a fluoride gas generated by performing electrolysis, wherein the conductive diamond catalyst carrier is detachably attached to the conductive electrode feeder at a lower portion, to be immersed in the electrolytic bath, wherein the conductive electrode feeder comprises any one of a conductive carbonaceous material, nickel and a nickel-copper alloy, wherein the conductive diamond catalyst carrier is detachably attached to the conductive electrode feeder with a screw or with a bolt and a nut, and wherein the screw or the bolt and nut comprises any one of a conductive carbonaceous material, nickel and a nickel-copper alloy, said method comprising:

holding the conductive diamond electrode structure so that at the portion to be immersed of the conductive electrode feeder, the conductive diamond catalyst carrier is immersed in a fluoride ion-containing molten salt electrolytic bath while an upper portion of the conductive electrode feeder remains exposed to the gas zone containing a fluorine gas or a fluoride gas generated by performing electrolysis, and performing electrolysis, thereby electrolytically synthesizing a fluorine-containing material.

2. A method for electrolytic synthesis of a fluorine-containing material according to claim 1, wherein the conductive diamond film is formed by a gas-phase synthesis method.

3. A method for electrolytic synthesis of a fluorine-containing material according to claim 2, wherein the gas-phase synthesis method is a chemical vapor deposition method.

4. A method for electrolytic synthesis of a fluorine-containing material according to claim 1, wherein the conductive substrate comprises any one of a conductive carbonaceous material, nickel and a nickel-copper alloy.

5. A method for electrolytic synthesis of a fluorine-containing material according to claim 1, wherein the conductive electrode feeder is a conductive carbonaceous material, and a metal coating film is formed on a bus bar joint at an upper end of the conductive electrode feeder by plating or thermal spraying.

6. A method for electrolytic synthesis of a fluorine-containing material according to claim 5, wherein the metal that forms the metal coating film is a metal selected from the group consisting of a conductive carbonaceous material, nickel and a nickel-copper alloy.

* * * * *